US005203223A

United States Patent [19]

Himmeroeder

[11] Patent Number: 5,203,223

[45] Date of Patent: Apr. 20, 1993

[54] COLD-FORMING OF TOOTHED WHEELS FROM SHEET STEEL

[75] Inventor: Helge Himmeroeder, Barrie, Canada

[73] Assignee: Tesma International Inc., Markham, Canada

[21] Appl. No.: 925,775

[22] Filed: Aug. 7, 1992

Related U.S. Application Data

[62] Division of Ser. No. 837,399, Feb. 19, 1992, Pat. No. 5,152,061.

[51] Int. Cl.[5] ..... F16H 55/12

[52] U.S. Cl. ..... 74/449; 74/460

[58] Field of Search ..... 74/434, 449, 457, 460; 29/893.32

[56] References Cited

U.S. PATENT DOCUMENTS

| | | | |
|---|---|---|---|
| 840,977 | 1/1907 | Warner et al. | 74/449 X |
| 1,377,175 | 5/1921 | Anderson | 29/893.32 |
| 2,729,110 | 1/1956 | Killian et al. | 74/449 X |
| 3,631,704 | 1/1972 | Leonard et al. | 29/893.32 |
| 3,745,851 | 7/1973 | Zeldman et al. | 29/893.32 |
| 3,894,418 | 7/1975 | Horl | 29/893.32 |
| 4,464,949 | 8/1984 | Concina | 74/449 |
| 4,796,345 | 1/1989 | Krapfenbauer | 74/438 |
| 4,945,783 | 8/1990 | Grob | 74/460 |

FOREIGN PATENT DOCUMENTS

| | | |
|---|---|---|
| 379364 | 7/1990 | European Pat. Off. . |
| 54-102277 | 8/1979 | Japan . |
| 63-101034 | 5/1988 | Japan . |
| 63-286232 | 11/1988 | Japan . |
| 755395 | 8/1980 | U.S.S.R. . |
| 1248710 | 8/1986 | U.S.S.R. . |

*Primary Examiner*—Allan D. Herrmann
*Assistant Examiner*—David W. Laub
*Attorney, Agent, or Firm*—Cushman, Darby & Cushman

[57] ABSTRACT

A cold-formed gear made from a single circular sheet of sheet metal. The gear is formed to have a central wall and a series of gear teeth surrounding the central wall. The teeth are formed in a outer annular section of the steel sheet by rolling contact with a cold-forming gear member. Extending from the outer annular section is a radial surface that supports the gear on a preform unit and then can be formed into a pulse ring for the gear.

2 Claims, 4 Drawing Sheets

COLD-FORMING OF TOOTHED WHEELS FROM SHEET STEEL

This is a division of application Ser. No. 07/837,399, filed Feb. 19, 1992 now U.S. Pat. No. 5,152,061.

This invention relates to toothed wheels of the type utilized in motor vehicles as, for example, in the starter assembly thereof and more particularly to improvements in the method of making such toothed wheels.

A motor vehicle usage of a mechanical part presents certain inherent problems which are peculiar to automotive use and are not presented in other uses. Today, the weight of the part is a particular problem and there is always a desire to reduce weight to a minimum commensurate with adequate strength. An extended useful life is also a highly prized characteristics. Moreover, due to the mass production basis upon which most motor vehicles and parts are made, the one most necessary attribute is cost-effectiveness.

Toothed wheels, as herein utilized, includes starter gears, toothed timing belt pulleys, pulse rings, and the like, with particular emphasis on starter gears.

Conventional practice in the manufacture of starter gears is to form an annular body from sheet metal by suitable cold-forming, as, for example, stamping and the like, which annular body provides the central wall of the gear and includes a peripheral configuration suitable to receive a separate ring gear. The ring gear is made from a ring of metal of rectangular cross-sectional configuration with the teeth being conventionally machined by a metal removal process. The starter gear is completed by spot-welding the ring gear to the peripheral configuration of the sheet metal body. The resultant construction while providing adequate service life is somewhat heavy and somewhat costly to manufacture.

It has long been known that substantial manufacturing cost and weight savings could be achieved if a satisfactory gear could be fabricated from a single piece of sheet metal by moving the sheet metal into the final configuration using cold-forming techniques. The so-called "Grob" machine has been available for some time which is operable to hammer in gear teeth or, more particularly, to hammer material in an annular blank radially inwardly to form the space between teeth on an indexed basis. Indeed, the patented literature contains proposals for making motor vehicle starter gears utilizing the Grob technique and machinery. For example, U.S. Pat. No. 4,796,345 discloses a method of making a starter gear which includes forming a preform from a circular piece of sheet metal by cold-forming an axial flange on the outer periphery of a circular blank and then forming the teeth in the periphery of the preform by the Grob hammering technique. As far as applicant is aware, gears made by the method of the '345 patent have not received any widespread acceptance in the motor vehicle marketplace.

A problem with this manner of formation is that it essentially transforms a cylindrical wall of a predetermined diameter into a scalloped wall having the same exterior diameter. Since the material in the annulus defined by the exterior and interior surfaces of the cylindrical wall is effectively spread out in scalloped fashion within a greater annulus defined by the same exterior cylindrical surface and a smaller interior cylindrical surface, it necessarily follows that the wall thickness is reduced. Moreover, the reduction comes in the central volute portion of the resultant teeth rather than the crests or troughs. In a gear construction which is operable to mesh with a similar gear, the forces tending to stress the metal are transmitting along the volute surfaces where the greatest weakness occurs. Consequently, in order to provide adequate strength to the volute area, a starting piece of sheet metal of greater thickness must be chosen which materially increases both weight and costs.

Another cost factor in practicing the method of the '345 patent is that the necessity to proceed on an indexed basis materially increases the time and energy required to process the gear. Recently, a machine has been made available commercially which has reduced the time and energy required to process the preform of the '345 patent into the finished product of the '345 patent by replacing the indexed hammering tool with a cold-rolling tool which forms the same end product. While the rolling tool formation would provide a reduction in the costs attributable to the indexed processing, the problem of reducing the costs resulting from the need to provide a heavier preform exists with respect to the toothed wheel made.

One attempt at solving the heavier preform problem is disclosed in U.S. Pat. No. 4,945,783. The patent proposes to preform a circular plate of sheet metal so that a circular peripheral edge of the plate is formed with a lip turned back to extend radially inwardly of the plate to define an outer peripheral portion having a U-shaped channel cross-section of generally uniform thickness. The preformed plate is then clamped to expose the radial outer surface of the U-shaped channel and to provide radially inward support of the lip edge. Thereafter, a rolling tool is rolled over the exposed outer surface along a path parallel with the axis of blank so that by indexing the blank after each rolling action a complete series of peripheral teeth are cold-formed. The procedure of the '783 patent is not optimal because it is inherently limited by the indexing mode of proceeding and for the additional reason that the sides of the teeth thus formed contain uncontrolled axial bulges which may present sharp edges requiring a costly machining step to finish. The uncontrolled axial bulges must be removed or, if they are smooth enough to be retained, they are superfluous to the strength and integrity of the finished teeth. In either event, material which could be used to lend strength and integrity to the teeth or the radially inward portion which backs up the teeth is either removed or retained as excess non-functional weight.

An object of the present invention is the provision of a method of making toothed wheels which achieves substantially all of the advantages of the prior art methods while substantially eliminating all of the disadvantages thereof. In accordance with the principles of the present invention, this objective is obtained by providing a method of forming a toothed wheel including a series of cold-formed peripheral teeth having sides spaced apart a predetermined distance utilizing (1) a rotary holding unit having structure providing a generally radially outwardly facing control surface and (2) a rotary tooth-forming tool unit having a rotational axis and a tooth-forming periphery extending annularly about the rotational axis. One of the rotary units includes two annular flanges extending outwardly thereof having two smooth tooth-side forming surfaces facing toward one another spaced apart the predetermined distance. The method comprises the initial step of cold-forming a circular piece of sheet metal of predetermined thickness into a preform having an outer annular section of generally uniform cross-sectional configuration and an integral sheet metal central wall generally of the predetermined thickness extending annularly inwardly from the outer annular section toward a preform axis, the outer annular section having (1) a width greater than the predetermined thickness but no greater than the predetermined distance, and (2) an outer periphery which will allow a meshing action with the tooth-forming periphery of the tooth-forming tool unit. The method also includes the step of rotating (1) the rotary holding unit with the preform secured thereto about the preform axis and with the control surface underlying at least a portion of the annular section and (2) the tooth-forming tool unit about the rotational axis thereof in a predetermined rotational relation wherein the axes are parallel and the rotational speeds are synchronized. While the rotary holding unit with the preform secured thereto and the tooth-forming tool unit are in the predetermined rotational relation, the method further includes the step of affecting a relative movement between the units and the axes thereof in a direction toward one another to engage the tooth-forming periphery of the tooth-forming tool unit in cooperating metal-deforming relation with the annular section inwardly of the exterior periphery thereof until the sheet metal of the annular section is cold-formed into the series of teeth, the peripheries of which are cold-formed by rolling contact with the tooth-forming periphery of the tooth-forming tool unit and portions of the sides of which are smooth and cold-formed by contact with the smooth tooth-side forming surface so that an amount of sheet metal which would otherwise uncontrollably flow axially outwardly of the smooth tooth-side forming surfaces is concentrated within the teeth and/or the radially inward back-up therefor.

Another object of the present invention is to provide a toothed wheel construction resulting from the practice of the aforesaid method which is cost effective in the manner previously indicated.

These and other objects of the present invention will become more apparent during the course of the following detailed description and appended claims.

The invention may best be understood with reference to the accompanying drawings wherein an illustrative embodiment is shown.

Figure 1:
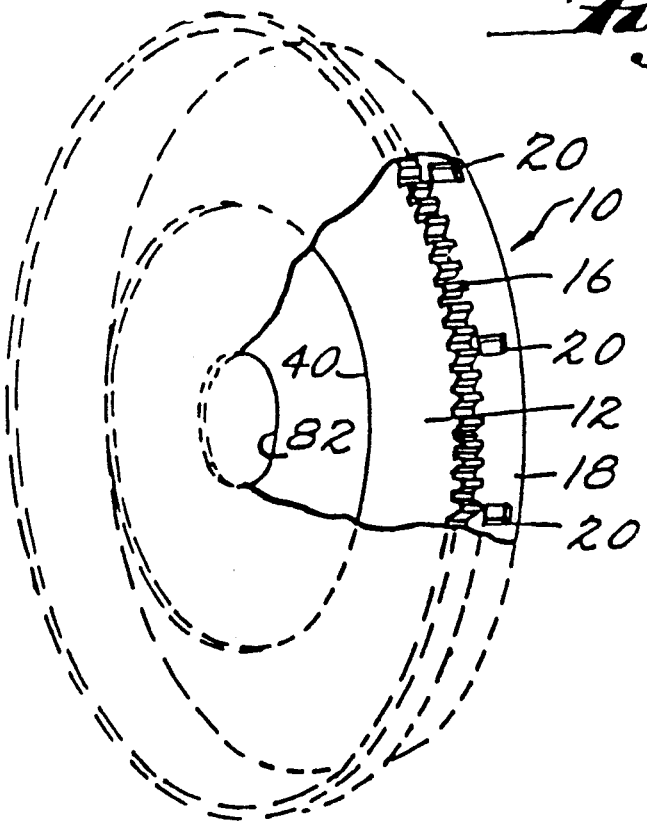
FIG. 1 is a perspective view partly in solid lines and partly in dotted lines of a starter gear with an integral pulse ring constructed in accordance with the method of the present invention.
Figure 2:
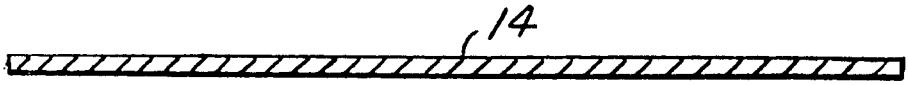
FIG. 2 is a fragmentary sectional view of one-half of a circular piece of sheet metal which constitutes the starting material in practicing the principles of the present invention.

Referring now more particularly to FIGS. 1–7, there is shown therein a toothed wheel in the form of a starter gear, generally indicated at 10, constructed in accordance with the principles of the present invention. FIGS. 2–6 illustrate various steps in the method of making the starter gear 10 in accordance with one embodiment of the method of the present invention. As shown, the starter gear 10 is made from a single circular piece of sheet metal, as, for example, steel capable of being cold-formed. As best shown in FIG. 1, the starter gear 10 includes a central wall 12 of sheet metal having a thickness generally equal to the predetermined thickness of the sheet metal which forms the starting material. FIG. 2 illustrates in cross-section one-half of a circular piece of sheet metal 14 the formation of which constitutes a first step in the method of the present invention.

The starter gear 10 also includes an annular section formed integrally with the outer periphery of the central wall 12, a portion of which is cold-formed into a series of gear teeth 16 and a portion of which defines pulse ring 18 in the form of an axially extending cylindrical flange having a series of openings 20 extending radially therethrough at regular intervals. As shown, there are twelve openings 20 equally spaced annularly about the axis of the starter gear 10 with each opening 20 being of generally rectangular configuration.

Figure 3:
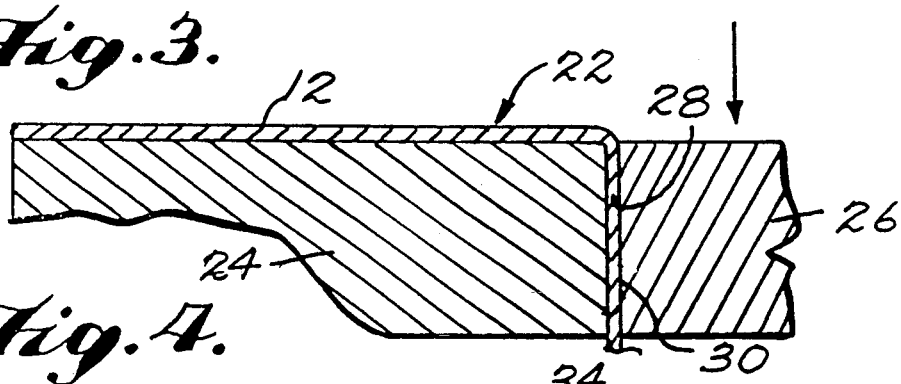
FIG. 3 is a view similar to FIG. 2 illustrating a first step in the process of the present invention wherein the circular piece of sheet metal is cold-formed into a can.

Referring now more particularly to FIG. 2, the circular piece of sheet metal 14 is illustrated therein to be a separate piece which may be stamped from a continuous sheet of steel. It will be understood that the separation of the circular starting piece 14 from a roll or continuous web of sheet material need not be accomplished in a single step wherein the circular piece 14 is produced for subsequent handling but may be only transitionally formed as a part of a multi-step sequence in the method. For example, the circular piece 14 could be a transitional part in the step of cold-forming a can 22. However, as shown in FIG. 3, the circular piece of sheet metal 14 is placed over a circular support 24 and a die 26 having a cylindrical opening 28 therein is moved axially so as to engage an outer annulus of the circular piece 14 and cold-form the outer annulus into a flange 30 extending axially from the outer periphery of a central wall 12 thereof.

Figure 4:
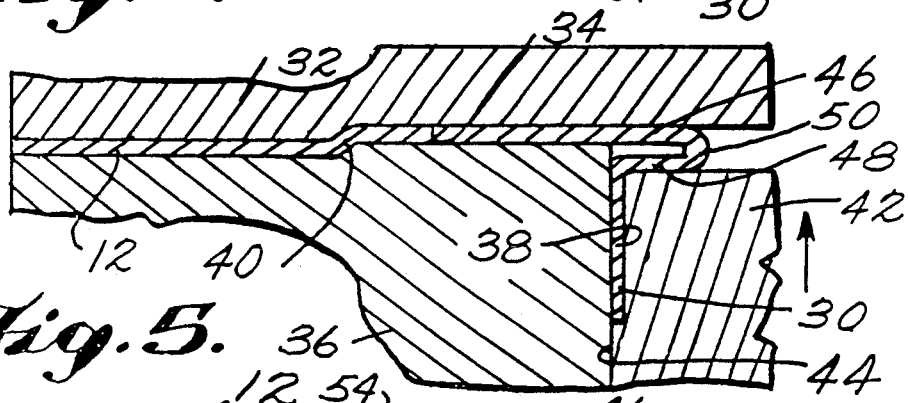
FIG. 4 is a view similar to FIG. 3 showing the next step in the method of the present invention including the formation of an annular section from the can.

Next, as shown in FIG. 4, the can 22 is placed so that the central wall 12 is in abutment with a support 32 having an annular recess 34 therein and a central plunger 36, which has an exterior cylindrical periphery 38 sized to engage within the axial flange 30 of the can 22, is moved toward the support 32 so as to form the central wall 12 of the can 22 with a central recess therein defined by an annular shoulder 40. A second outer annular plunger 42 is then moved toward the support 32 and the plunger 42 has an interior periphery 44 which is of notched cylindrical configuration so as to engage both the exterior surface and the end surface of the axial flange 30 of the can 22.

During the movement of the outer annular plunger 42 toward the support 32, the portion of the axial flange 30 adjacent the central wall 12 is bulged out so as to form two annular side-by-side wall portions 46 and 48, one of which is integral at its inner periphery with the outer periphery of the center wall 12 and the other of which is integral at its inner periphery with the adjacent end of the remaining portion of the axial flange 30. The outer periphery of both annular wall sections 46 and 48 are integrally interconnected as indicated at 50. At the end of these procedures, the original circular piece of sheet metal 14 has now been cold-formed into a non-thickened preform which includes the center wall 12 having an outer annular section integral with the outer periphery thereof, which includes the two side-by-side annular wall portions 46 and 48 and the remaining portion of the axial flange 30.

Figure 5:
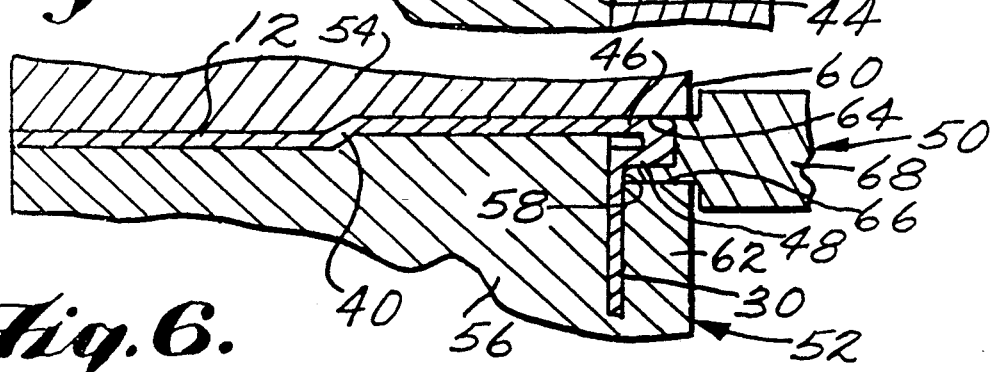
FIG. 5 is a view similar to FIG. 4 showing the next step in the method of the present invention wherein a final preform is cold-formed by thickening the annular section.
Figure 6:
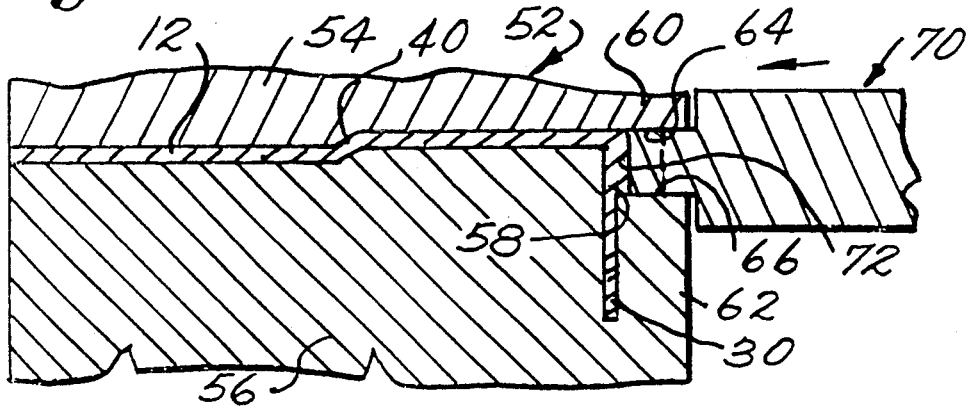
FIG. 6 is a view similar to FIG. 5 showing the teeth forming step in the method of the present invention wherein the thickened annular section of the preform is cold-formed into a series of teeth.

Referring now more particularly to FIG. 5, the unthickened preform is next secured with a rotary holding unit, generally indicated at 52, which includes a pair of complementary annular holding members 54 and 56. As shown in FIG. 5, the holding member 54 engages one side of the central wall 12 and the other holding member 56 engages the opposite surface of the central wall 12 and includes a generally radially outwardly facing control surface 58 extending generally axially from the outer periphery of the central wall 12 in a position underlying the interconnection 50, annular wall portion 48, and the remaining portion of the axial flange 30. In the embodiment shown, the holding members 54 and 56 include annular flanges 60 and 62, respectively, which extend beyond the associated annular section when the non-thickened preform is secured therein. It will be noted that the flanges 60 and 62 include oppositely facing tooth-side forming surfaces 64 and 66, respectively, which, as shown, are of smooth planar configuration disposed radially and parallel with one another spaced apart a predetermined distance which is greater than the predetermined thickness of the sheet metal. The non-thickened preform thus secured in the rotary holding unit 52 is then cold-formed into a final thickened preform by moving a rotary thickening tool 68 radially inwardly into engagement with the connection 50 at the outer periphery of the annular wall portions 46 and 48 of the non-thickened preform while the rotary holding unit 52 is rotated to thus cold-form the outer periphery of the annular section radially inwardly into a configuration wherein the integral connection 50 between the two annular wall portions 46 and 48 is thickened as well as the adjacent portions of the annular wall portions themselves.

Figure 7:
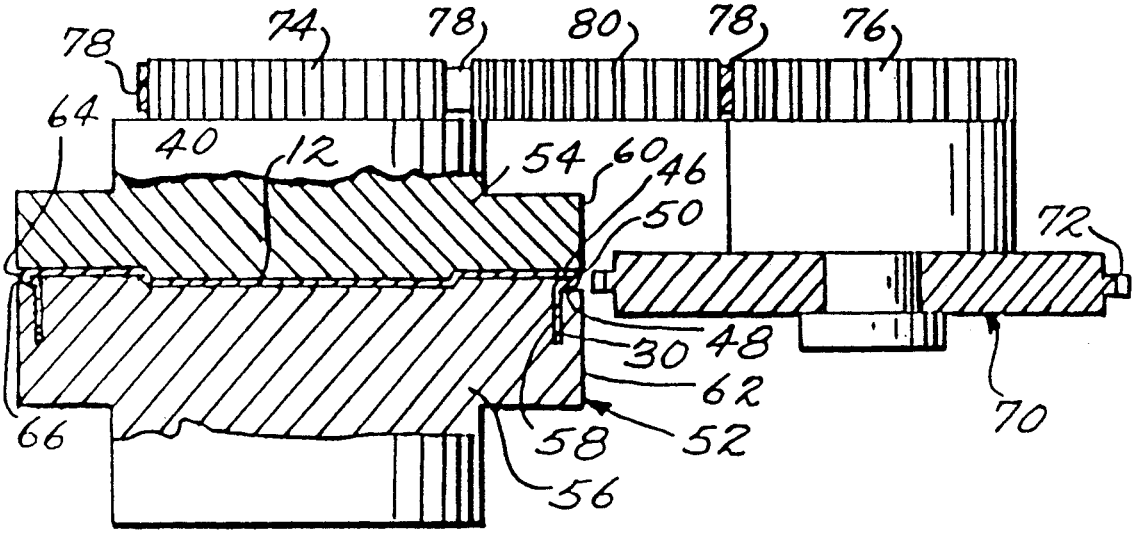
FIG. 7 is a sectional view illustrating the entire rotary holding unit and rotary tooth forming unit shown in FIG. 6.

The next cold-forming step in the present method is to cold-form the series of teeth 16 in the thickened annular section of the final preform while it is retained in secured relation with the rotary holding unit 52. FIG. 7 illustrates that the rotary holding unit 52 forms a part of a cold-forming machine capable of cold-forming the series of teeth 16 in the annular section of the preform. The cold-forming of the series of teeth 16 is accomplished by a rotary tooth forming tool unit, generally indicated at 70, having a tooth forming tool structure 72 on the exterior periphery thereof. The rotary tooth forming unit 70 forms a part of a machine which provides a means for effecting a rotational movement of the rotary holding unit 52 and the rotary tooth forming tool unit 70 in a predetermined rotational relationship wherein the axes are parallel and the rotational speeds are synchronized.

Any suitable motion-transmitting means may be provided in the machine for effecting the rotational relationship. For example, as shown, the rotary holding unit 52 has a timing belt pulley 74 fixed to rotate therewith and the rotary tooth forming tool unit 70 is likewise provided with a timing belt pulley 76 which rotates therewith. A timing belt 78 is trained about the two timing belt pulleys 74 and 76 and a pair of movable idler pulleys 80 in such a way that the rotational relationship between the two rotary units 52 and 70 is maintained while permitting a relative movement between the two units and the axes thereof toward and away from one another. The timing belt 78 is of a type which includes timing teeth on both the interior and exterior surfaces thereof. The teeth on the interior periphery, as shown, are trained about the exterior periphery of the timing belt pulley 76 fixed with respect to the rotary holding unit 52 while the exterior teeth of the timing belt 78 are trained about the timing belt pulley 76 fixed to the rotary tooth forming tool unit 70. The two idler pulleys 80, which are on opposite sides of a plane passing through the axes of rotation of the two units, are movable to take up any belt configuration change as a result of the relative movement of the two units toward and away from one another with the movement of the idlers 80 being commensurate so as to maintain the synchronous rotational movement.

In this regard, it will be noted that the directions of rotation of the rotary units 52 and 70 are in opposite directions so that the tooth forming periphery 72 of the rotary tool unit 70 can be moved into meshing relation with the periphery of the annular section of the preform secured to the rotary holding unit 52. It will also be noted that the thickness of the performed annular section is greater than the predetermined sheet metal thickness and no greater than the predetermined distance between surfaces. More specifically, as shown, the thickness of the annular section is slightly greater than twice the predetermined thickness of the sheet metal but less than the predetermined distance between the tooth side forming surfaces 64 and 66 of the flanges 60 and 62.

Once the predetermined rotational relationship has been established, the two rotary units 52 and 70 will be rotated in the predetermined rotational relationship which, for example, is an identical speed in opposite directions of 150–180 revolutions per minute. With the two rotary units 52 and 70 in the position shown in FIG. 7 and while the rotational relationship is retained, a relative movement between the two rotary units and their parallel vertical axis (as viewed in FIG. 7) in a direction toward one another is effected. Preferably, the rotary tool unit 70 is moved while the axis of rotation of the rotary holding unit 52 is held stationary; although both units could be moved or only the rotary unit 52 could be moved. An exemplary feed rate of the movement of the axis of the rotary tool unit 70 toward the axis of the rotary holding unit 52 is approximately 120 mm. per minute. As the outer tool forming periphery 72 of the tool forming tool unit 70 moves to engage the periphery of the annular section of the preform in cooperating metal deforming relation inwardly of the exterior periphery thereof, the sheet metal of the annular section is cold-formed into a series of teeth. Preferably, this is accomplished by effecting a movement of the rotary tool unit 70 toward the holder unit to an extent which equals about four meshing turns. When this feed movement has been reached, the drive for the two units is reversed and then the feed movement is advanced until four more meshing turns are accomplished. These alternative direction feeds are repeated until the full tooth configuration has been completed.

Thus, during the infeed, the peripheries of the series of teeth 16 are cold-formed by rolling contact with the tooth forming periphery 72 of the tooth forming tool unit 70 and portions of the sides of the series of teeth 16 are cold-formed by contact with the smooth tooth side forming surfaces 64 and 66 of the flanges 60 and 62 so that an amount of sheet metal which would otherwise uncontrollably flow axially outwardly of the smooth tooth-side forming surfaces is concentrated within the teeth and/or the radially inward back-up therefor. In this regard, it will be noted that the control surface 58 which is cylindrical has the effect of controlling the radially inward movement of the annular section during the cold-forming of the series of teeth. In the preferred embodiment, the control surface 58 is cylindrical and initially contacts the interior of the remaining portion of the axial flange 30 so that, during the cold-forming of the series of teeth 16, the contact is made a pressure contact and preferably full control surface contact of the annular section also occurs as it is moved radially inward during the cold-forming of the series of teeth 16.

Preferably, the volume of the annular section is such that, at the completion of the cold-forming of the series of teeth 16, sheet metal will be cold-formed into contact with the entire control surface 58 extending from the outer periphery of the central wall 12. Moreover, the smooth tooth side forming surfaces 64 and 66 preferably contact substantially the entire sides of the teeth except for a rounded transitional area adjacent the crests thereof. In this way, the amount of metal provided in the annular section of the preform is concentrated in the teeth and the back-up for the teeth which is radially inwardly of the finished product. This ensures maximum strength for minimum weight. The purpose of the transition surfaces between the smooth sides of the teeth formed by contact with the surfaces 64 and 66 and the periphery of the teeth themselves is to provide a tolerance volume which can vary depending on the exact volume of material in the annular section of the preform prior to the cold-forming of the teeth. In this regard, it is greatly preferred that the annular section have an outer peripheral dimension which is at least as great as the crest dimension of the series of teeth and does not exceed this dimension to an extent of approximately 107% or functionally an amount which would enable a meshing relationship between the annular section of the preform and the periphery of the tooth forming tool unit when initial engagement occurs. This size relationship insures that it is not necessary to cause cold flow in a radially outward direction but rather that the direction of cold flow of metal is either axially outwardly or radially inwardly or a combination of both. It will be understood however that, in its broadest aspects, the method does comprehend cold flow radially outwardly. Moreover, while the aforesaid transitional surfaces preferably provide for whatever volumetric tolerances are encountered, it would also be possible to provide for such tolerance by virtue of the cold flow of the metal of the annular section not reaching a contact relationship with the control surface 58 when the cold-forming of the series of teeth 16 has been completed.

As best shown in FIG. 1, the central wall 12 is centrally apertured, as indicated at 82, which is a cold-forming step that may be accomplished after the series of teeth 16 are cold-formed or preferably this opening is formed prior thereto. Another cold-forming step which is made after the series of teeth 16 have been cold-formed is the stamping of the series of openings 20 of rectangular configuration at regular intervals along the remaining portion of the axial flange 30. The exterior surface of the remaining portion of the axial flange 30 is preferably machined in a lathe to form the pulse ring 18 with an accurate cylindrical exterior surface which intersects with the openings 20 to accurately provide signals at regular intervals which are used to provide computer control for the engine.

In the case of the starter gear 10 made in accordance with the above procedure, it is desirable that the final configuration be given a heat treatment at least in the area of the series of teeth 16. Preferably, the heat treatment is by induction heating to a temperature of 850° to 900° C. followed by quenching in water to room temperature. Heat treatment is considered desirable in the case of a starting gear because of the severe loads which are imposed along the volute surfaces of the teeth in operation. With the present invention, the teeth can be made to be substantially solid in the central area where the load is supplied by limiting an otherwise uncontrolled cold flow axially outwardly and by controlling radially inward cold flow by the outwardly facing control surface 58. Indeed, where the cold flow of the steel material is made to contact the cylindrical control surface 58 throughout, the entire teeth are solid including a back-up annulus. However, as previously indicated in its broader aspects, the back-up annulus can have a tolerance void. As, while a cylindrical control surface 58 is greatly preferred, it will be understood in its broadest aspects, the invention could be performed with a control surface which is scalloped or discontinuous. In forming other toothed wheels, such as timing belt pulleys and pulse rings, the provision of an integral pulse ring with the series of teeth may be eliminated and the heat treatments can likewise be eliminated.

Figure 8:
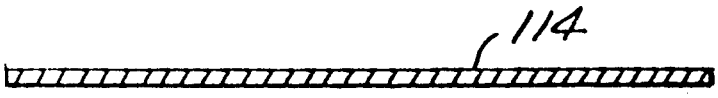
FIGS. 8, 9 and 10 are views similar to FIGS. 2–6 illustrating steps in performing another embodiment of the method of the present invention.
Figure 9:
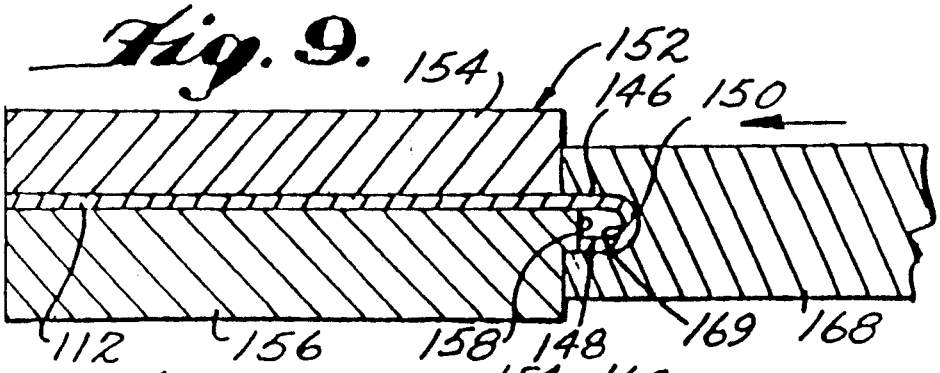
Figure 10:
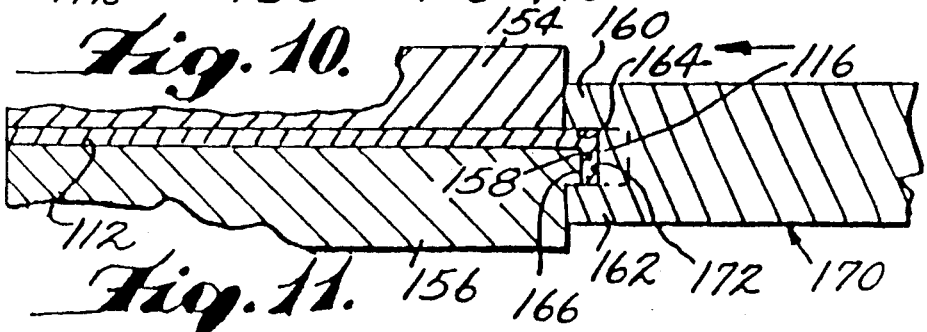

FIGS. 8–10 illustrate additional method step variations which are within the contemplation of the present invention. FIG. 8 illustrates a circular piece of sheet metal 114 of predetermined thickness which is secured in a rotary holding unit 152 of modified form including first and second annular holding members 154 and 156. As shown, the holding member 156 is formed with outwardly facing cylindrical control surface 158 which extends generally axially from a central portion of the circular piece of sheet metal 114 at the outer periphery thereof which defines the central wall 112 of the finished product. A variation in the rotary holding unit 152 shown in FIG. 9 from the unit 52 shown in FIG. 7 is that the unit 152 does not include outwardly extending flanges 60 and 62 providing tooth side forming surfaces 64 and 66. Instead, the rotary holding unit 152 is recessed where the flanges 60 and 62 were previously provided. The recessed holding member 154 and 156 cooperate with a rotary preform rolling member 168 having a U-shaped groove 169 formed in its outer periphery.

By advancing the rotary preform rolling member 168 with respect to the rotary holding unit 152 in a manner similar to the rotary member 68 previously described, an outer annulus of the circular piece 114 extending radially outwardly beyond the control surface 158 is cold-formed into a peripheral flange extending outwardly and then downwardly from a curved control portion so as to provide a cross-sectional configuration which opens generally radially inwardly. The preform configuration of the annular section is cold-formed by the preform rolling member 168. While it could be of inverted semi-circular shape it is more of an inverted U-shaped configuration having a pair of side-by-side annular wall portions 146 and 148 integrally interconnected by a central arcuate transitional wall portion 150.

It will be understood that the annular section provided by wall portions 146, 148, and 150 could be thickened by utilizing a thickening tool similar to the tool 68, in the method according to FIG. 8–10. In the method according to FIGS. 8–10, the next step is to cold-form the annular section into a series of teeth 116. This is accomplished by a rotary tooth forming tool unit 170 which is constructed and operated like the rotary tooth forming tool unit 70 except that, in addition to a tooth forming periphery 172, the tool unit includes a pair of flanges 160 and 162 extending generally radially outwardly on opposite sides of the tooth forming periphery 170. The flanges 160 and 162 have smooth planar oppositely facing radially extending tooth-side forming surfaces 164 and 166. The surfaces 164 and 166 perform the same tooth side restricting and forming function during the cold-forming movements of the tool unit 170 with respect to the holding unit 152 as the surfaces 64 and 66 during the movements of the units 52 and 70. It will be noted, however, that the resultant tooth sides are formed by a relative sliding contact with the surfaces 164 and 166 rather than the relatively stationary contact with the surfaces 64 and 66. While the tooth side forming surfaces 164 and 166 are shown as being parallel, they can be planar or smoothly curved surfaces which diverge outwardly with respect to one another.

Figure 11:
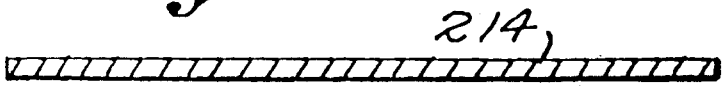
FIGS. 11–13 are views similar to FIGS. 8–10 illustrating steps in still another embodiment of the method of the present invention.
Figure 12:
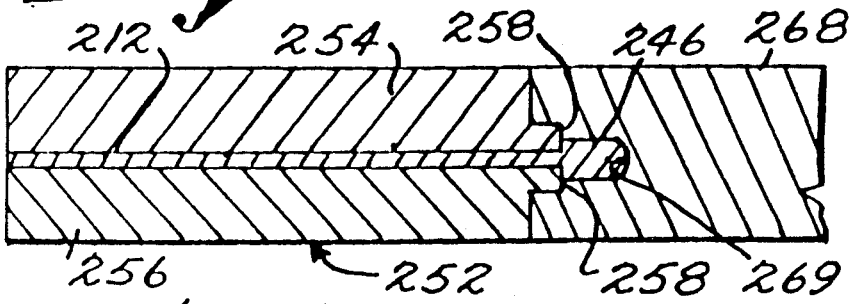
Figure 13:
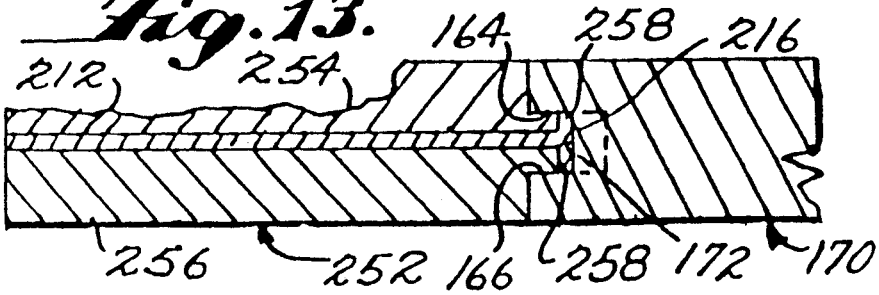

Referring now more particularly to FIGS. 11–13, there is shown therein another variation in the steps of the process according to the present invention. Again, FIG. 11 illustrates a starting circular piece of steel sheet metal 214. The circular piece is then secured within a rotary holding unit, generally indicated at 252, which is of slightly modified construction when compared with the units 52 and 152 previously described. As before, the rotary holding unit 252 includes two rotary holding members 254 and 256, the outer peripheries of which are recessed like members 154 and 156 rather than being flanged as members 54 and 56. However, instead of a single control surface being provided on the member 56 or 156, as before, each of the members 254 and 256 are provided with a control surface 258.

The circular piece 214 is secured between the members 254 and 256 so that the control surfaces 258 extend radially outwardly in opposite directions from the outer periphery of a central portion of the circular piece 214 which defines a central wall 212.

The outer annulus of the circular piece 214 extending beyond the control surfaces 258 is thickened to provide an annular section 246 which together with the integral control wall constitutes a preform. The cold-forming of the annular section is accomplished by the operation of a rotary thickening tool 268 having a U-shaped thickening slot 269 formed in the exterior periphery thereof.

As before, by advancing the rotary thickening tool 268 in conjunction with the rotation of the rotary holding unit 252, the outer annulus of the circular piece 214 is thickened into a solid annular section 246 having a width less than the width of the teeth to be formed. It will be noted that, during the thickening operation, the steel cold flows into contact with inner portions of the control surfaces 258. The outer diameter of the annular section 246 is slightly greater than the crest diameter of the teeth to be formed.

A series of teeth 216 are cold-formed in the solid annular section 246 by utilizing the flanged tooth forming tool unit 170 in the same manner as previously described.

Figure 14:
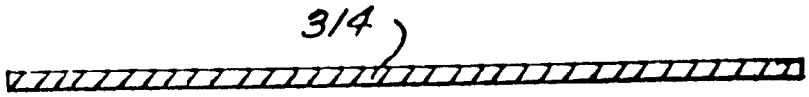
FIGS. 14–17 are view similar to FIGS. 2–6 illustrating steps in still another modification of the method of the present invention.
Figure 15:
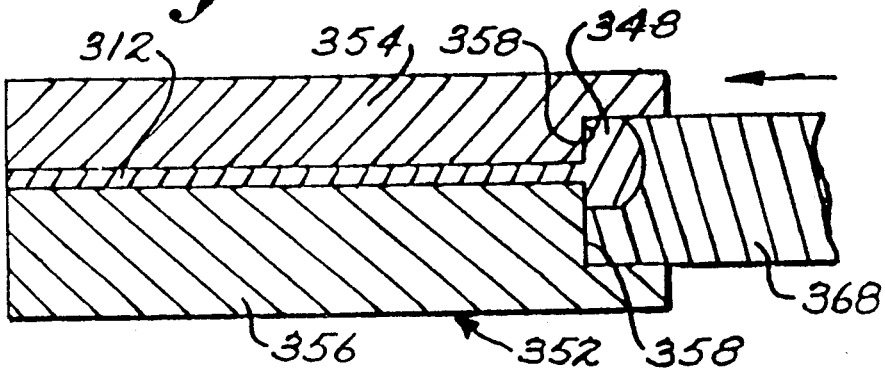
Figure 16:
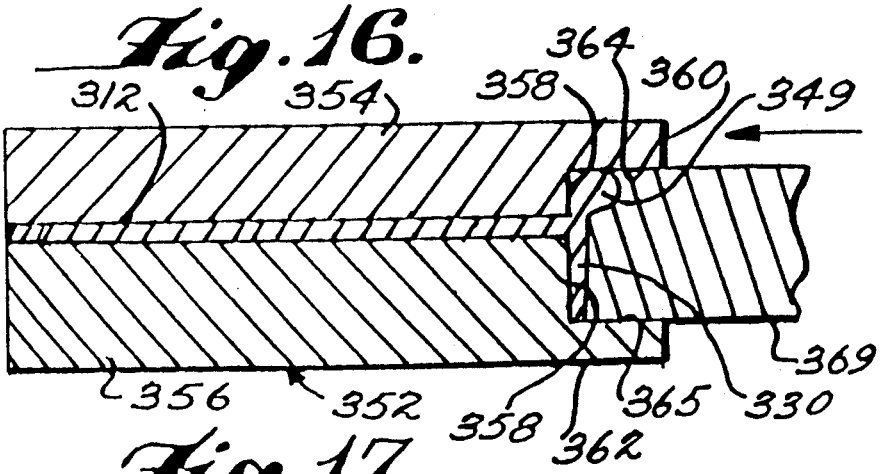
Figure 17:
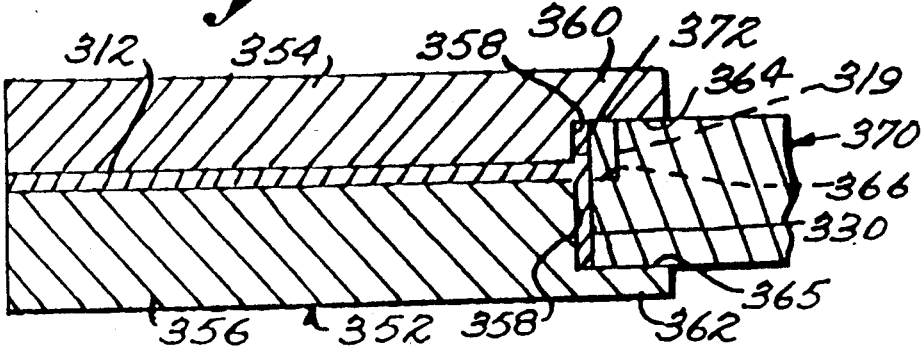

Referring now more particularly to FIGS. 14–17, there is shown therein still other method step modifications within the principles of the present invention. Here again, FIG. 14 illustrates a starting circular piece of steel sheet metal 314. The circular piece 314 is secured with a rotary holding unit 352 which differs somewhat from the units 52, 152, and 252 previously described. As before, the unit 352 includes two rotary holding member 354 and 356. As with the unit 252, each of the holding members 354 and 356 includes an outwardly facing cylindrical control surface 358. Unlike the units 152 and 252, but like the unit 52, the holding members 354 and 356 include flanges 360 and 362 respectively. Flange 360 includes a tooth side forming surface 364 and flange 362 has an oppositely facing surface 365.

As before, the circular piece 314 is secured between the holding members 354 and 356 so that the control surfaces 358 extend generally axially outwardly in opposite directions from the outer periphery of a central portion of the circular piece which constitutes a central wall 312. The annulus of the circular piece 314 is thickened into an initial solid annular section 348 by utilizing a initial thickening tool 368 in the same manner as the thickening tool 68. Thereafter, a second thickening tool 369 is used in a similar manner to cold-form the initial annular section 348 into a final solid annular section 349 having an axial flange 330 extending therefrom. As shown, the axial flange 330 is integral with the central wall 312 and contacts the control surface 358 of holding member 356 along its inner periphery and the outer end thereof contacts flange surface 365. The annular section 349 is integral with the end of the axial flange 330 which is integral with the central wall 312. Again, it will be noted that the annular section 349 has a width greater than the predetermined sheet steel thickness but less than the width of the teeth to be formed. The interior surface of the annular section is in contact with the control surface 358 on the holding member 354. Again, the outer periphery of the annular section 349 is slightly greater than the crest diameter of the teeth to be formed.

After the preform is cold-formed including central wall 312, axial flange 330 and annular section 349, the latter is cold-formed into a series of teeth 316. The teeth are formed by using a rotary tooth forming tool unit 370 similar to the unit 70 in a similar fashion. The rotary tool unit 370, in addition to the peripheral teeth forming structure 372, also includes a flange 373 which extends radially outwardly therefrom alongside the tooth forming periphery 372. The flange 373 provides tooth-side forming surfaces 366 which are spaced a predetermined distance from the tooth-side forming surface 364 of the holding unit 352. When the units 352 and 370 are operated in the manner previously indicated with respect to the units 52 and 70, it will be noted that one side of the series of teeth 316 is formed by stationary contact with the tooth-side forming surface 364 on flange 360 of the unit 352 while the opposite side of the series of teeth 316 is formed by sliding contact with the tooth-side forming surface 366 on the flange 373 of the unit 370.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A toothed wheel cold-formed from a circular piece of sheet steel of predetermined thickness comprising a central wall generally of said predetermined thickness and an outer annular section extending annularly around an outer periphery of said central wall having a series of teeth therein, said outer annular section having smooth opposite side surfaces spaced apart a predetermined distance greater than said predetermined thickness provided by steel from the circular piece having an interior grain configuration cold-formed by generally axially outward contact with cold-forming surfaces, an exterior peripheral surface in tooth formation provided by steel from the circular piece having an interior grain configuration cold-formed by rollingly meshing engagement with tooth-forming surfaces of a rotary tooth-forming tool unit, and generally radially inwardly facing transitional surface means extending generally axially from the outer periphery of said central wall provided by steel from the circular piece having an interior grain configuration cold-formed by generally radially inward pressure contact with control surface means of a rotary preform holding unit.

2. A toothed wheel as defined in claim 1 wherein said exterior peripheral surface is a starter gear tooth formation and said outer annular section includes an integral pulse ring in the form of an axially extending cylindrical flange having a series of openings formed therein at regular annular intervals.

* * * * *